US011357343B2

(12) United States Patent
Sanders

(10) Patent No.: US 11,357,343 B2
(45) Date of Patent: Jun. 14, 2022

(54) MODULAR CANDLE HOLDER, VASE AND CADDY

(71) Applicant: Kriellion Antionette Sanders, Newington, VA (US)

(72) Inventor: Kriellion Antionette Sanders, Newington, VA (US)

( * ) Notice: Subject to any disclaimer, the term of this patent is extended or adjusted under 35 U.S.C. 154(b) by 0 days.

(21) Appl. No.: 16/746,831

(22) Filed: Jan. 18, 2020

(65) Prior Publication Data

US 2020/0237120 A1 Jul. 30, 2020

Related U.S. Application Data

(60) Provisional application No. 62/918,336, filed on Jan. 25, 2019.

(51) Int. Cl.

| | |
|---|---|
| ***A47G 7/06*** | (2006.01) |
| ***F21V 35/00*** | (2006.01) |
| ***F21S 13/12*** | (2006.01) |
| ***A47G 7/04*** | (2006.01) |

(52) U.S. Cl.

CPC ..... *A47G 7/06* (2013.01); *F21V 35/00* (2013.01); *A47G 7/041* (2013.01); *F21S 13/12* (2013.01)

(58) Field of Classification Search

CPC ..... A47G 7/06; A47G 7/066

USPC ..... 362/101

See application file for complete search history.

(56) References Cited

U.S. PATENT DOCUMENTS

| | | | | |
|---|---|---|---|---|
| 3,146,955 | A * | 9/1964 | Sabuco | F21V 33/0028 362/122 |
| 5,930,951 | A * | 8/1999 | Wong | A01G 9/02 47/66.1 |
| D417,169 | S | 11/1999 | Drucker | |
| 6,029,937 | A | 2/2000 | Funaro | |
| 6,684,565 | B2 * | 2/2004 | Kemp | A47F 7/0078 47/83 |
| D494,690 | S | 8/2004 | Peddada | |
| 7,036,954 | B1 | 5/2006 | Cordle et al. | |
| 2004/0227607 | A1 * | 11/2004 | Yen | F21V 23/00 336/145 |
| 2005/0148913 | A1 * | 7/2005 | Weston | A61M 1/0088 602/2 |
| 2007/0203266 | A1 * | 8/2007 | Holmes | B65D 39/0011 524/13 |
| 2009/0109663 | A1 * | 4/2009 | Tsai | A61L 9/122 362/190 |

(Continued)

OTHER PUBLICATIONS

H. Pereira, Rationale behind Cork Properties: A Review of Structure and Chemistry, 2015, BioResources 10(3), pp. 6207-6229 (Year: 2015).*

(Continued)

*Primary Examiner* — Keith G. Delahoussaye

(74) *Attorney, Agent, or Firm* — Kriellion Sanders

(57) ABSTRACT

A modular assembly comprising at least one holder, base-unit having at least one hollow opening on at least one end and further comprising at least one adapter-unit; wherein said adapter-unit plugs securely into the hollow opening of said holder, base-unit; and wherein said holder, base-unit and said at least one adapter-unit may be interchanged and combined with alternate holder, base-units and adapter-units to form a variety of cohesive, convertible assemblies which function as a vase, a plant stand, a candle holder and/or a caddy for various articles.

21 Claims, 4 Drawing Sheets

(56) References Cited

U.S. PATENT DOCUMENTS

| | | | | |
|---|---|---|---|---|
| 2009/0202978 | A1* | 8/2009 | Shaham | A01N 1/0257 435/1.3 |
| 2013/0094195 | A1* | 4/2013 | Gerson | F21S 9/02 362/190 |
| 2013/0205662 | A1* | 8/2013 | Yancey | A01G 27/02 47/66.6 |
| 2017/0146229 | A1* | 5/2017 | Kercher, III | C11C 5/002 |
| 2018/0283633 | A1* | 10/2018 | Roberts | F21S 6/001 |
| 2020/0003412 | A1* | 1/2020 | Bianchini | F23Q 25/00 |

OTHER PUBLICATIONS

Author Unknown, How to Put a Cork Back Into a Wine Bottle, TheWineAerator.com, https://www.thewineaerator.com/how-to-put-a-cork-back-in-a-wine-bottle 2020.

* cited by examiner

MODULAR CANDLE HOLDER, VASE AND CADDY

CROSS-REFERENCE TO RELATED APPLICATIONS

This applicant claims benefit under 35 U.S.C. 119(e) to the filing date of U.S. Provisional Patent Application Ser. No. 62/018,336, entitled Modular Candle Holder, Vase and Caddy, filed Jan. 25, 2019.

BACKGROUND OF THE INVENTION

It is common to present floral arrangements in vases, particularly for gifting. However once natural flowers wilt and die all that remains is the vase. It is common to display wax, soy and battery-operated candles on or in candle holders, also particularly for gifting. However, once the candle has burned completely, or any scent contained therein has expired, all that remains is a candle holder with or without an expired candle. It is common to provide tools and useful articles in caddies so that they may be easily organized. Certain types of tools and articles are particularly suitable for gifting. However, once the tools or articles are lost, broken or depleted, the caddy may have no further purpose and is often discarded. A common trend at weddings and special events is to feature centerpieces and displays of towering heights. However, such designs may be cumbersome to store and transport. The current invention serves to provide a modular assembly of various holder, base-units which may be combined with an assortment of removable and interchangeable adapters, to produce a variety of cohesive, convertible assemblies which function as a candle holder, a vase, a plant stand, or a caddy for various articles. The modular assemblies may be redesigned to exhibit multiple utilities and styles and to allow large or tall designs to be stored or transported in modular sections. The modular assemblies of the invention may be repurposed, repeatedly. For those in the special event trades, these assemblies could alleviate the need for costly inventory, since the modular units may be assembled to exhibit a variety of utilities, styles and sizes. Because of this vast diversity in style and function, the modular candle holder, vase and caddy assembly of this invention is particularly suitable for gifting and for use at special occasions and events such as weddings.

SUMMARY OF THE INVENTION

The current invention is a modular assembly comprising at least one holder, base-unit having at least one hollow opening at its top surface, and further comprising at least one removable, interchangeable plug-in, adapter-unit. The plug-in, adapter-unit has a top portion and a bottom portion. The top portion functions as a vase, plant stand, candle holder or caddy. The bottom portion is a plug comprised of silicone, rubber, cork, wood and/or plastic. Said plug inserts securely into the hollow opening at the top of the holder, base-unit. The holder, base-unit and the adapter-unit may be interchanged and combined with alternate holders and adapters of suitable design to form a variety of cohesive, convertible assemblies which may function as candle holder, vase, plant stand, or caddy for various articles. The invention will allow an assembly useful for one purpose to be transformed or converted for use as an alternate purpose. For example, an assembly being used as a candleholder may be transformed into a vase simply by changing the plug-in adapter.

Holder, Base-Unit

The holder, base-unit may be designed in any fashion that will function as a holder. A preferable design is that of a candle holder wherein said candle holder may display a taper candle, a tea light candle, a votive candle, a pillar candle, or a battery-operated candle or light. The holder, base-unit has at least one hollow opening at the top surface into which at least one removable, interchangeable, plug-in, adapter-unit may be inserted. The holder, base-unit may also have an additional, hollow, bowl-like portion at its bottom surface, wherein when the holder is inverted and the hollow, bowl-like portion is at the top, the holder, base-unit may also function as a caddy.

Plug-in, Adapter-Unit

The plug-in, adapter-unit is comprised of a top portion and a bottom portion. The top portion provides function and/or style. The bottom portion comprises a non-threaded, plug which serves to connect the adapter to the holder, base-unit. More particularly, the bottom portion of the plug-in, adapter-unit comprises a non-threaded plug comprised of silicone, rubber, cork, wood and/or plastic, and inserts securely into the hollow opening of the holder, base-unit. The term "non-threaded" indicates that the plug does not screw into the hollow opening but is rather inserted simply by pushing the plug into the hollow opening. A secure insertion is achieved when there are no gaps between the boundaries of the hollow opening of the holder, base-unit and the exterior of the plug. A secure fit is evidenced when the plug does not wobble or wiggle when inserted. The top portion of the plug-in, adapter-unit provides function and design elements to the modular assembly. The adapter may have any aesthetically pleasing design that is proportionately appropriate for the holder, base-unit. An appropriate proportion for the adapter would ensure that the adapter is not so large or small to render the assembly non-functional or unattractive. The adapter may function as any or all of a vase, a plant stand, a taper candle holder, a tea light candle holder, a votive candle holder, a pillar candle holder, a battery-operated-candle holder or a holder or caddy for various articles.

The term holder or caddy for various articles is intended to encompass any type of container suitable for holding useful tools and accessories. Examples of these useful tools and accessories comprise:

1. A vase or container for flowers and plants.
2. A caddy for office tools including but not limited to pens, pencils, scissors, rulers, paperclips, staples, staplers and hole-punches.
3. A caddy for construction tools including but not limited to screwdrivers, hammers, pliers, levels, files, sanders, wrenches, ratchets, and saws.
4. A caddy for garden tools and supplies including but not limited to garden shears, garden spades, garden seeds and plant nutrients.
5. A caddy for home scents and accessories including but not limited to incense, scented oils, scented sprays and diffusers.
6. A caddy for bathroom accessories including but not limited to soap dishes, canisters, toothbrush holders, cups and decanters.
7. A caddy for kitchen, bar and/or grill implements such as cutlery, cutting tools, cooking tools, baking tools, grilling tools, bar tools, mixing tools, measuring tools, food storage tools and serving tools; including but not limited to spoons, forks, knives, spatulas, tongs, thermometers, straws, measuring spoons, measuring cups, picks, skewers, stirrers, bottle openers, cocktail shakers, strainers, bar spoons, muddlers, jiggers, tongs, spatulas, scrapers, grill mitts, wood chips, trays, bottles, baskets, dispensers, bottles, jars, cups, plates, trays, napkins, and napkin rings.

8. A caddy for personal care implements such as beauty tools, manicure tools, pedicure tools, shaving tools, bath and spa tools, bath and spa products, skin care products and makeup for face and body; including but not limited to makeup brushes and sponges, eyelash curlers, nail files, emory boards, nail clippers, nail scissors, buffers, cuticle trimmers, pumice stones, mirrors, nail polish, skin-foundations, powders, lipsticks, lip gloss, mascara, eyeliner, eyeshadow, contour, blush, shaving foam, shaving brushes, face towels, razors, back scratchers, loofas, sponges, towels, soaps, lotions, perfumes and body scents.
9. A caddy for wearable protective care items such as items to protect against weather, items to protect against sports injuries and items to provide for personal care including but not limited to hats, visors, gloves, scarves, gators, shoe covers, boots, fans, ponchos, umbrellas, gloves, headbands, mouthguards, towels, wraps, reading glasses, sunglasses, protective eyewear, contact lens cases, eyeglass cases, sunshade cases, wearable eyeglass holders, eyeglass repair tools and cleansing items for eyewear.
10. A caddy for clothing care implements including but not limited to clothes hangers, clothes pins, closet sachets, clothes brushes, lint rollers, fabric softeners and detergents.
11. A caddy for travel accessories including but not limited to luggage tags, passport folders, electrical adapters, maps and translators.
12. A caddy for electronics and accessories including but not limited to iPod and tablet holders, stylus pens, speakers, headphones, chargers, USB connectors, memory sticks, hard drives, Bluetooth devices, cell phone covers, selfie sticks, earbuds and remote controls.
13. A caddy for sports equipment including but not limited to balls, bats, clubs, rackets, gloves, mitts, socks, shoes, cleats, helmets, guards.
14. A caddy for toys including but not limited to games, puzzles, books, models, cars, plush animals, blocks, books, clay, paints, crayons, costumes and dolls.
15. A caddy for pet care items including but not limited to collars, leashes, bedding, pet toys, and whistles.

DETAILED DESCRIPTION OF THE PREFERRED EMBODIMENTS

The drawings of the invention including FIGS. 1 through 4 further serve to define and illustrate the embodiments of the invention in a more detailed manner.

Figure 1:
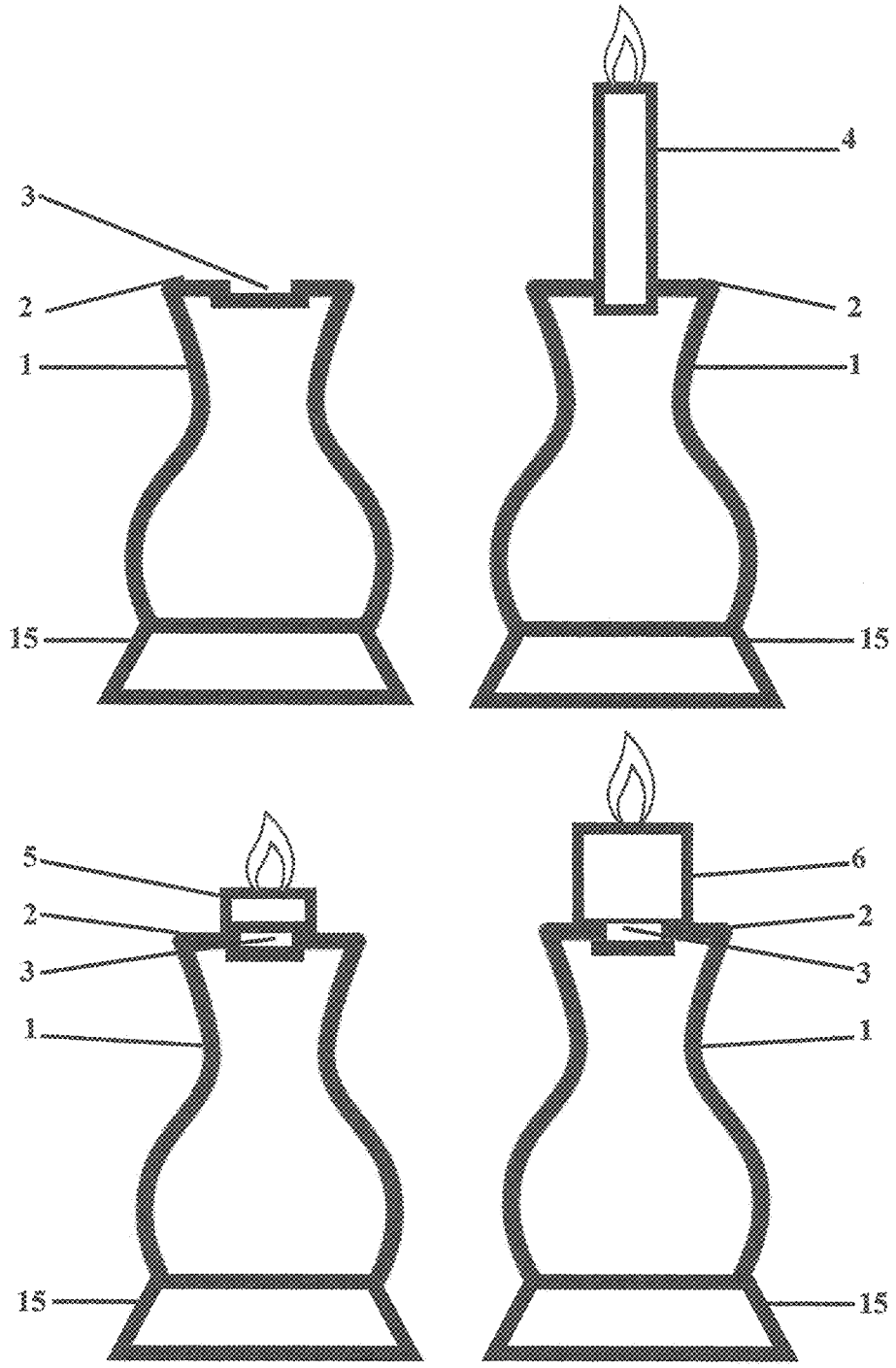
FIG. 1 depicts base holder designs having no adapter attached and having various types of candles inserted into the hollow opening.

FIG. 1 shows as a component of the presently claimed modular assembly, a holder, base-unit 1 designed to accommodate five types of candles including taper, tea light, votive, small pillar and large pillar. The candle may be wax, soy or battery-operated plastic. The top surface of the candle holder 2 has a hollow opening 3. In a preferred embodiment, the hollow opening is located in the center of the top surface of the holder, base-unit 1 and may be designed to accommodate a standard taper candle 4. In this embodiment, the hollow opening is approximately ¾ inches in diameter and is approximately 1 inch in depth. However, the hollow opening may be of any suitable size. When the holder, base-unit 1 is a candle holder, said candleholder may be a multifunctional candle holder designed to accommodate several different types of candles, as shown. Said candleholder may accommodate a tea light or votive candle 5 which sits on the top surface of the base holder 1. Said candleholder may also accommodate a pillar candle 6 which sits on the top surface of the base holder 1. The holder, base-unit 1 may also have an additional, hollow, bowl-like portion 15 at its bottom surface, wherein when the holder, base-unit is inverted and the hollow, bowl-like portion is at the top, the holder, base-unit may function as a caddy.

Figure 2:
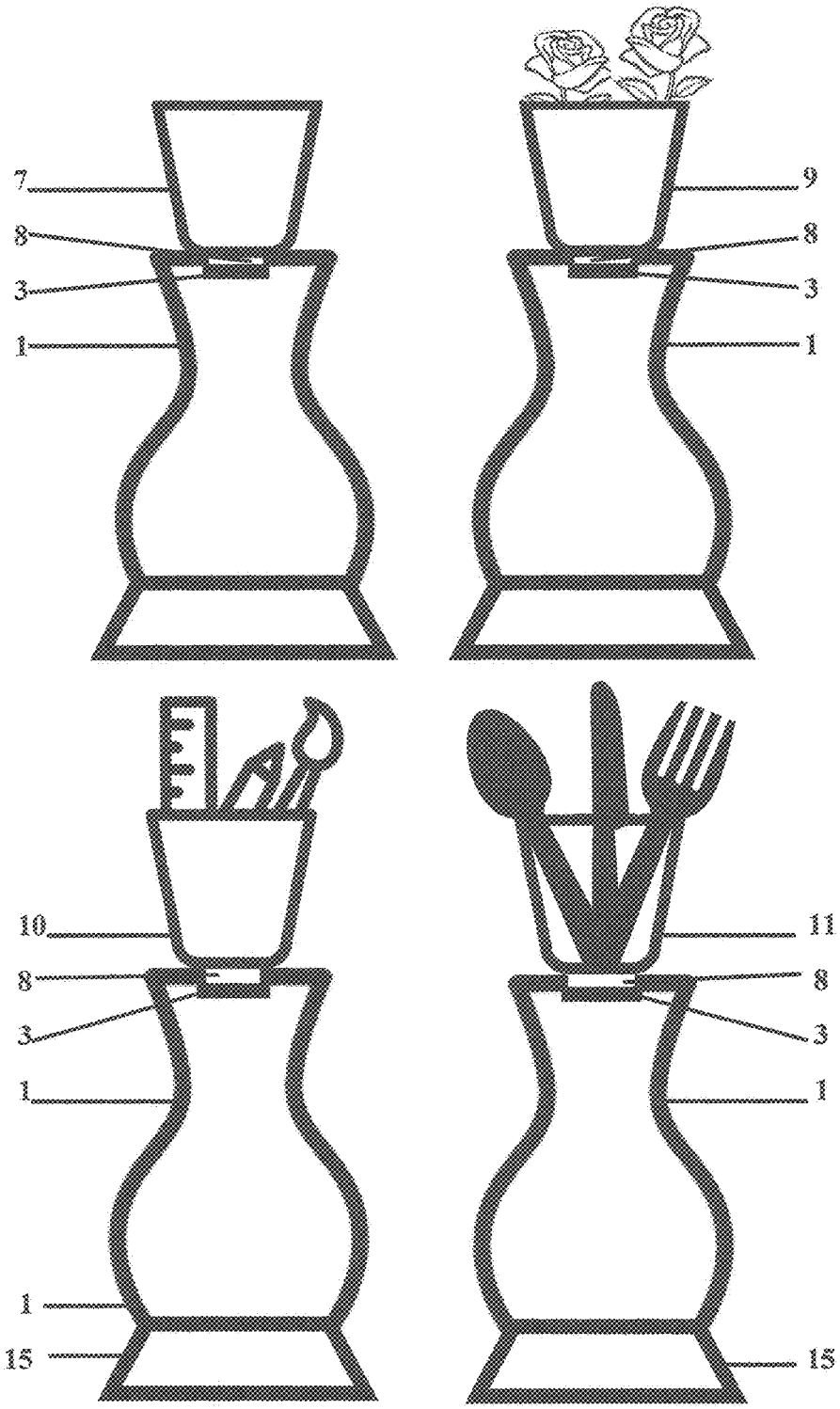
FIG. 2 shows the modular assembly including the base holder as a candleholder which also has the adapter attached. Each view of the cohesive, convertible modular assembly displays a different functional style for the adapter inserted into the hollow opening.

FIG. 2 shows as a component of the presently claimed modular assembly, a holder, base-unit 1 and an adapter-unit 7 attached to the holder, base-unit 1 by a plug 8 inserted into the hollow opening 3. In this embodiment the adapter 7 which is shown as an empty caddy could be used to hold a variety of useful articles ranging from plants to pet accessories as further described above.

The holder, base-unit 1 in this embodiment is also a candleholder having a hollow opening 3 designed to accommodate a taper candle when no adapter is inserted. Additionally, in this embodiment, the plug measures approximately ¾ inches in diameter, (give or take ⅛ inch), and is designed to insert securely into the hollow opening of the candle holder base. The plug may be comprised of silicone, rubber, cork, wood and/or plastic. A secure insertion of the plug is best achieved when there are no gaps between the boundaries of the perimeter of the hollow opening of the holder, base-unit and the outside perimeter of the plug. A secure insertion is evidenced when the plug does not wobble or wiggle when inserted. A secure insertion is necessary to ensure that when items are placed in the top portion of the adapter the assembly does not topple and fall. Another embodiment of the adapter-unit is one which is designed as a vase 9. Another embodiment of the adapter-unit is one which is designed as a caddy for office tools 10. Another embodiment of the adapter-unit is one which is designed as a caddy for kitchen tools 11. The adapter-unit may serve as a caddy for any item that is functionally and aesthetically suitable.

Figure 3:
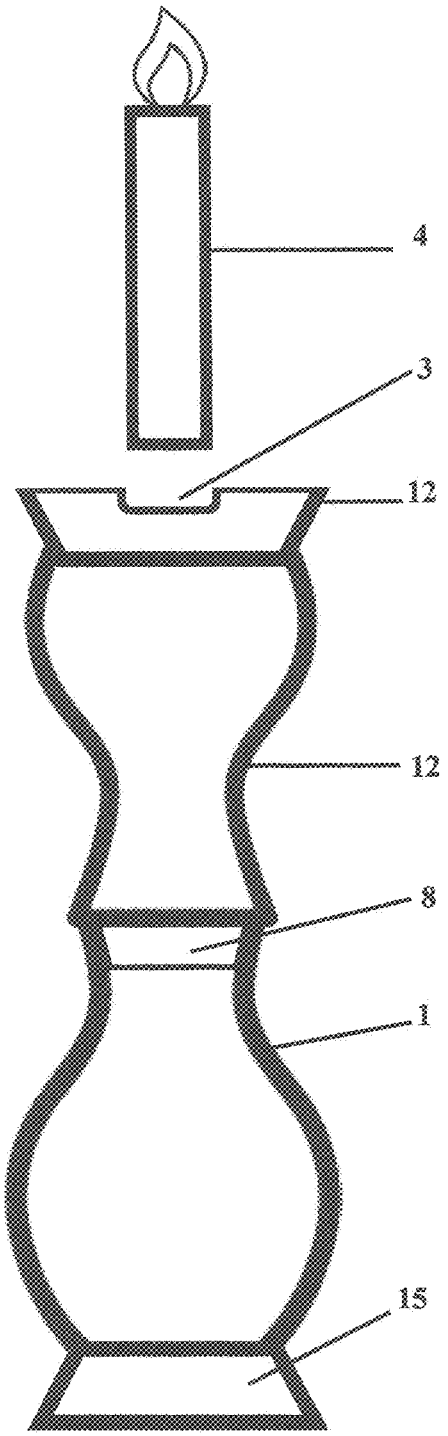
FIG. 3 shows a modular assembly having a base holder with an adapter inserted, wherein the adapter is a candle holder which is designed to accommodate a taper candle.

FIG. 3 shows as an embodiment of the presently claimed modular assembly, a holder, base-unit 1 having an adapter-unit 12 inserted into a hollow opening of said holder, base-unit 1 via a plug 8. The adapter-unit 12 is a candle holder which also has a hollow opening 3 which may accommodate an additional adapter-unit. This embodiment allows for a plurality of base units and adapters to be stacked on top of each other to facilitate the assembly of tall designs. The holder, base-unit 1 may also have an additional, hollow, bowl-like portion 15 at its bottom surface, wherein when the holder, base-unit is inverted and the hollow, bowl-like portion is at the top, the holder, base-unit may function as a caddy.

Figure 4:
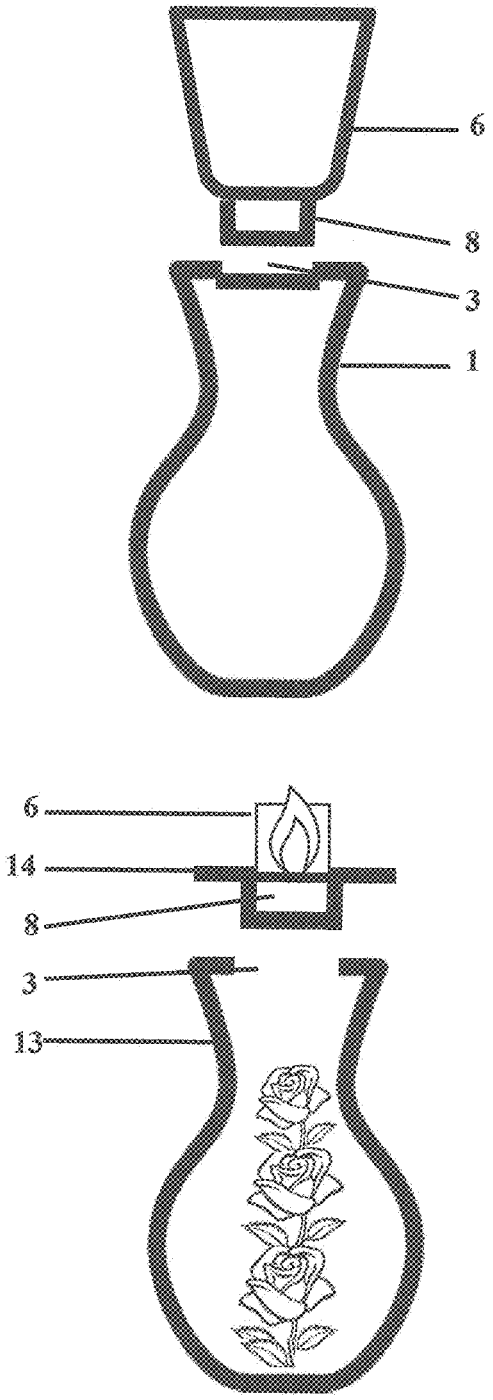
FIG. 4 shows a base holder with an adapter above it prior to the adapter being inserted into the holder.

FIG. 4 depicts the adapter-unit in relation to the holder, base-unit prior to its insertion therein. FIG. 4 illustrates suitable sizing and positioning of the adapter plug to allow for secure insertion of said plug into the holder base. FIG. 4 also shows as an embodiment of the presently claimed modular assembly, a holder, base-unit 13 which functions as a vase. An adapter 14 functions as a candle holder and may be inserted into the hollow opening 3 of the holder, base-unit 13 via a plug 8.

The above description presents optimum, dimensional, relationships for the modular components of the invention. It is understood that one skilled in the art would consider variations in size, shape, form, functions and materials of the components as well as variations in the manner of operation, assembly and use thereof. All embodiments equivalent to those illustrated in the drawings and described in the specification are intended to be encompassed by the present invention. Therefore, the foregoing is considered as only illustrative of the principles of the invention. Since numerous modifications and variations will readily occur to those skilled in the art. The description of the invention is not intended to limit the invention to the exact construction and means of operation shown and described. Accordingly, all suitable modifications and equivalents falling within the scope of the invention may be practiced.

I claim:

1. A modular unit comprising a hollow container having at least one open end and further comprising at least one plug-in adapter wherein said adaptor plugs securely into an open end of said container; wherein said hollow container without the adapter(s) either functions as a vase, or a container for flowers and plants, or functions as a caddy or a holder for various articles; and wherein said plug-in adapter has a top portion which functions as either a plant stand, a vase, a taper candle holder, a tea light candle holder, a votive candle holder, a pillar candle holder, a battery-operated candle holder, or a battery operated light holder and wherein said plug-in adapter has a bottom portion which is a plug comprised of silicone or cork; wherein said plug portion of said plug-in adapter fits securely into said open end of the hollow container portion of the modular unit; and wherein said modular unit including the hollow container when combined with said adapter(s) forms a convertible modular unit which also functions as a plant stand, taper candle holder, tea light candle holder, votive candle holder, pillar candle holder, battery-operated candle holder or battery operated light holder.

2. The modular unit of claim 1, wherein said at least one open end measures ¾ inches in diameter and said at least one plug-in adapter measures ⅝ to ⅞ inches.

3. The modular unit of claim 1 wherein the at least one adapter has a top portion which is either a plant stand, or a vase and a bottom portion which is a plug that fits securely in the container.

4. The modular unit of claim 1 wherein the at least one adapter has a top portion which is a taper candle holder, a tealight-candle holder, a votive candle holder or a pillar candle holder and a bottom portion which is a plug that fits securely in the container.

5. The modular unit of claim 1 wherein the at least one adapter has a top portion which is a battery-operated-candle holder or a battery-operated light holder and a bottom portion which is a plug that fits securely in the container.

6. The modular unit of claim 1 wherein the hollow container is a caddy for office tools.

7. The modular unit of claim 1 wherein the hollow container is a caddy for construction tools.

8. The modular unit of claim 1 wherein the hollow container is a caddy for garden tools and supplies.

9. The modular unit of claim 1 wherein the hollow container is a caddy for home scents and accessories.

10. The modular unit of claim 1 wherein the hollow container is a caddy for bathroom accessories.

11. The modular unit of claim 1 wherein the hollow container is a caddy for kitchen, bar and grill implements.

12. The modular unit of claim 1 wherein the hollow container is a caddy for personal care tools and implements.

13. The modular unit of claim 1 wherein the hollow container is a caddy for wearable protective care items.

14. The modular unit of claim 1 wherein the hollow container is a caddy for clothing care implements.

15. The modular unit of claim 1 wherein the hollow container is a caddy for travel accessories.

16. The modular unit of claim 1 wherein the hollow container is a caddy for electronics and accessories.

17. The modular unit or claim 1 wherein the hollow container is a caddy for sports equipment.

18. The modular unit or claim 1 wherein the hollow container is a caddy for toys.

19. The modular unit or claim 1 wherein the hollow container is a caddy for pet care items.

20. A modular unit comprising a hollow container having at least one open end and further comprising at least one plug-in adapter wherein said at least one plug-in adapter plugs securely into an open end of said container; wherein said hollow container without the adapter(s) either functions as a vase, or a container for flowers and plants, or functions as a caddy or a holder for various articles; and wherein said plug-in adapter has a top portion which functions as either a plant stand, a vase, a taper candle holder, a tea light candle holder, a votive candle holder, a pillar candle holder, a battery-operated candle holder, or a battery operated light holder and wherein said plug-in adapter has a bottom portion which is a plug comprised of silicone; wherein said plug portion of said plug-in adapter fits securely into said open end of the hollow container portion of the modular unit; and wherein said modular unit including the hollow container when combined with said at least one plug-in adapter(s) forms a convertible modular unit which also functions as a plant stand, taper candle holder, tea light candle holder, votive candle holder, pillar candle holder, battery-operated candle holder or battery operated light holder.

21. A modular unit comprising a hollow container having at least one open end and further comprising at least one plug-in adapter wherein said at least one plug-in adapter plugs securely into an open end of said container; wherein said hollow container without the adapter(s) either functions as a vase, or a container for flowers and plants, or functions as a caddy or a holder for various articles; and wherein said plug-in adapter has a top portion which functions as either a plant stand, a vase, a taper candle holder, a tea light candle holder, a votive candle holder, a pillar candle holder, a battery-operated candle holder, or a battery operated light holder and wherein said plug-in adapter has a bottom portion which is a plug comprised of cork; wherein said plug portion of said plug-in adapter fits securely into said open end of the hollow container portion of the modular unit; and wherein said modular unit including the hollow container when combined with said at least one plug-in adapter(s) forms a convertible modular unit which also functions as a plant stand, taper candle holder, tea light candle holder, votive candle holder, pillar candle holder, battery-operated candle holder or battery operated light holder.

* * * * *